US005594966A

United States Patent [19]

Goldman

[11] Patent Number: 5,594,966

[45] Date of Patent: Jan. 21, 1997

[54] KNIFE WITH BLADE SHARPENER STORED IN KNIFE HANDLE

[75] Inventor: Paul D. Goldman, Marlboro, Mass.

[73] Assignee: Saint-Gobain/Norton Industrial Ceramics Corporation, Worcester, Mass.

[21] Appl. No.: 150,630

[22] Filed: Nov. 10, 1993

[51] Int. Cl.[6] ..... B26B 11/00

[52] U.S. Cl. ..... 7/120; 7/162; 7/170; 451/523; 451/524; 451/558

[58] Field of Search ..... 7/120, 118, 162, 7/169, 170; 51/391, 392, 205 R, 265 WG; 451/557, 558, 523, 524

[56] References Cited

U.S. PATENT DOCUMENTS

| | | | |
|---|---|---|---|
| 1,012,555 | 12/1911 | Irick | 7/120 |
| 1,232,886 | 7/1917 | Boston | 7/120 |
| 4,259,815 | 4/1981 | Kuban | 51/205 R |

*Primary Examiner*—James G. Smith

*Attorney, Agent, or Firm*—Volker R. Ulbrich

[57] ABSTRACT

A blade sharpener for a pocket knife is in the form of an appendage which can be removably secured to the knife handle and which carries a superabrasive layer sharpening surface, such as an electroplated diamond grit. The appendage may take the form of a pair of tweezers, such as those commonly found on Swiss army type knives, with the superabrasive layer being attached to its inside surfaces.

14 Claims, 1 Drawing Sheet

FIG. 1
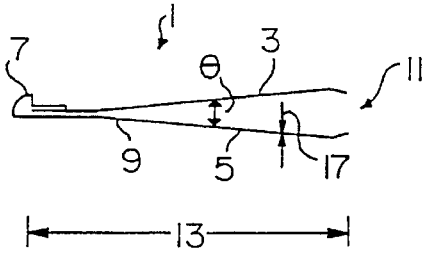
FIG. 2
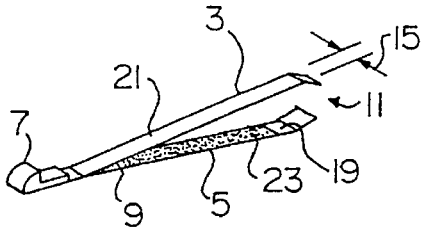
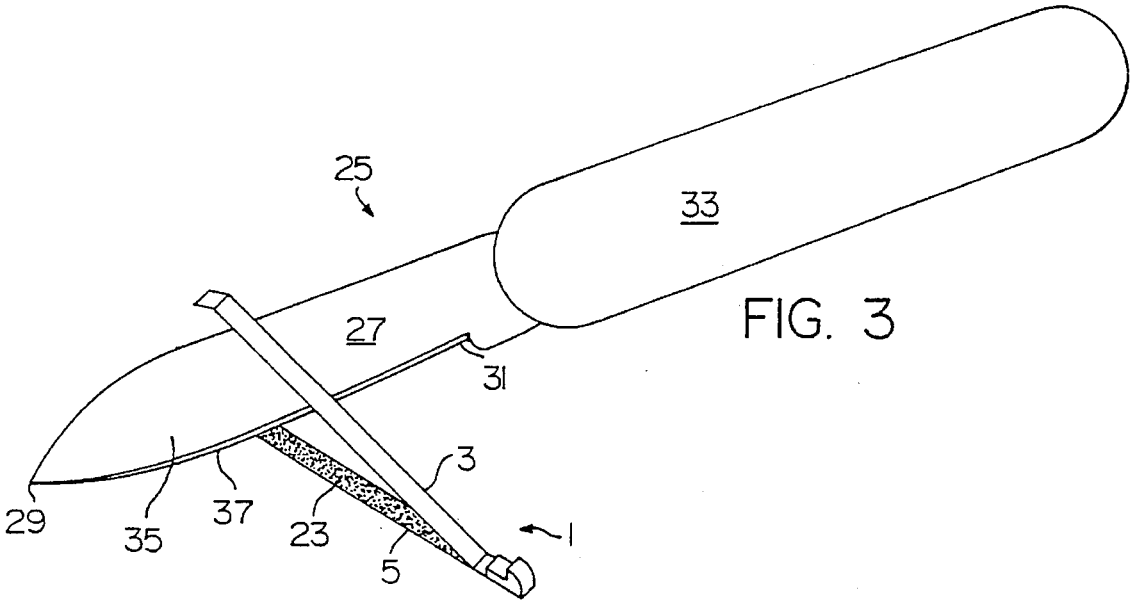
FIG. 3
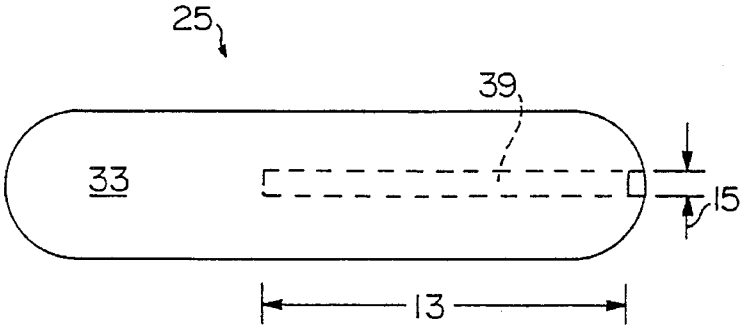
FIG. 4

KNIFE WITH BLADE SHARPENER STORED IN KNIFE HANDLE

TECHNICAL FIELD

This invention relates to cutlery combined with a sharpening feature, and more particularly to a superabrasive sharpening device which is compact, highly durable, and can easily be carried with and secured to a pocket knife.

BACKGROUND OF THE INVENTION

The effective and safe use of a knife requires occasional sharpening to maintain a keen edge. For a knife which is used at a single location, a sharpening device, such as a whetstone or a sharpening steel can be conveniently stored nearby. For a knife which is carried about, the carrying along of a separate sharpening device can be inconvenient, since the device can be bulky if it is a stone or can be easily lost if it is a smaller item, such as a tungsten carbide or ceramic device. For this reason, some knives designed for carrying have a sharpening device stored in or built into a sheath. The sharpening surface can be a feature of the sheath because the sheath can be moved relative to the knife. This is not the case for folding knives, since they typically need no sheath for carrying. Thus there is a need for a sharpening device which can be attached to a folding knife, but which is removable.

SUMMARY OF INVENTION

According to the present invention, a knife blade sharpening device is provided in the form of a removable appendage which is adapted to be secured to a knife and includes superabrasive material surface for sharpening. In further accord with the present invention, the knife blade sharpening device includes a plurality of superabrasive layers of varying abrasive texture. In still further accord with the present invention, the knife blade sharpening device includes a V-shaped appendage with two arms, each having an inside and an outside surface, and superabrasive layer secured to the inside surface of each arm. In still further accord with the present invention, the V-shaped appendage comprises a pair of tweezers of the general shape and size which are commonly fitted to pocket knives, said tweezers having been modified to also serve as a blade sharpener. In yet still further accord with the present invention, the superabrasive layer includes a diamond grit which is secured to the appendage.

Another feature of the present invention is the ease and cost efficiency with which the invention can retrofit certain existing pocket knives. Swiss army folding type pocket knives commonly include a pair of tweezers as one of their detachable features. Such tweezers are suited to embody the V-shaped appendage of the present invention when a superabrasive layer is bonded to the tweezers. Thus, preexisting pocket knives which accept such tweezers may be retrofitted with the present invention merely by replacing the detachable tweezers with the tweezers of the present invention.

BRIEF DESCRIPTION OF THE DRAWINGS

FIG. 1 is a front view of pocket knife tweezers which are modified to also serve as a blade sharpener according to one embodiment of the present invention.

FIG. 2 is a perspective view of the tweezers of FIG. 1.

FIG. 3 is a perspective view of a knife being sharpened by the blade sharpener of FIG. 1.

FIG. 4 is a side view of a knife adapted to secure the blade sharpener of the FIG. 1.

DETAILED DESCRIPTION

FIG. 1 illustrates a blade sharpening device embodied in a set of tweezers 1 according to the present invention. The tweezers 1 include an upper arm 3 and a lower arm 5. The upper arm 3 and lower arm 5 are attached in cantilever fashion at a plastic head 7. A crotch 9 is the area proximate to the head 7 where the arms 3, 5 meet. An angle θ represents the angle between the upper arm 3 and the lower arm 5 near to the crotch 9. A jaw 11 is located opposite to the head 7.

The arms 3, 5 are manufactured from a folded single or from two metal strips. Each arm has a length 13, a width 15 (FIG. 2 only) and a thickness 17 dimension. The length 13 is typically about 5 centimeters. The width 15 (FIG. 2 only) is typically several millimeters. The thickness 17 is typically about a half a millimeter. The arms 3, 5 are fastened together at the head 7 by means well known in the art, and are substantially parallel for about the first centimeter of their length 13 beginning at the head 7 and ending at the crotch 9. From the crotch 9 toward the jaw 11, the arms 3, 5 splay outward at the angle θ which is between 10 and 20 degrees, becoming bent inward or substantially parallel for the final 3 millimeters or so of their length 13 in the jaw 11 area.

The arms 3, 5 are constructed of a metal which is, in the requisite dimensions, sufficiently soft to bend under light pressure and sufficiently resilient to regain its original posture upon the release of that pressure. The arms 3, 5 close by moving inward toward each other. When force is applied to the arms 3, 5, that portion of the arms proximate to the jaw 11 will bend to a greater degree than the portion proximate to the crotch 9. Thus, the angle θ will remain substantially constant even as the arms 3, 5 close toward each other.

FIG. 2 illustrates the various surfaces of the tweezers 1. The lower arm 5 has an inner surface 19 and an outer surface (not illustrated). Likewise, the upper arm 3 has an inner surface (not illustrated) and an outer surface 21. In a preferred embodiment, a superabrasive layer 23 is provided as a sharpening surface on the inner surface (not illustrated) of the upper arm 3 and the inner surface 19 of the lower arm 5. The superabrasive layer 23 covers the area from the point where the arms 3, 5 meet in the crotch 9 substantially to the jaw 11, but spaced sufficiently from both the crotch 9 and the jaw 11 to avoid interfering with the proper functioning of the tweezers 1. Further, the superabrasive layer 23 on both arms 3, 5 is of the same abrasive texture.

Alternatively, the superabrasive layer 23 on the upper and lower arms 3, 5 could have differing abrasive texture to accommodate rough and fine sharpening procedures. In further alternative, the superabrasive layer 23 could be bonded to one or more of the outside surfaces. In still further alternative, the superabrasive layer 23 could be bonded to only one inside surface. Those skilled in the art will readily discern the use and manufacture of these alternative embodiments in light of the present disclosure.

In a preferred embodiment, the superabrasive layer 23 comprises a diamond grit superabrasive populated region which is bonded to the arms 3, 5 by electroplating. The particle size of the diamond grit is from about 100/120 to about 200/230 mesh size, and preferably about 140/170 mesh, but is largely a matter of personal preference. The most practical source for the diamond grit is high temperature, high pressure synthesis. The diamond grit could also be made from natural diamond or produced by chemical vapor deposition (CVD). Other forms of abrasive grit such as silicon carbide, aluminum oxide and the like could also be used.

Alternatively, a single free standing slab of diamond layer produced by CVD could be used as the superabrasive layer. Such a slab can be produced on a substrate such as silicon by dissociating hydrogen with a hot filament or other energy source in the presence of a carbon containing gas at relatively low pressure. Following deposition, the substrate is etched away, leaving a free standing diamond layer. The layer is then etched to obtain the appropriate abrasive texture, and attached to the tweezers 1. It is also possible to deposit such a diamond layer directly onto the tweezers 1, provided the metal which makes up the arms 3, 5 is a viable substrate material.

Alternative means of fixing the layer to the arms include double faced adhesive tape, epoxy, braze, solder or other adhesives. However, the actual means of attachment is not critical to the present invention, and those skilled in the art can doubtless recite other means sufficient to accomplish the task.

FIG. 3 illustrates a knife 25 being sharpened with the sharpener of the present invention. The knife 25 has a blade 27 with a pointed tip 29, and a root 31 section proximate to a hilt 33. The blade 27 has a first side 35 and a second side (not illustrated), corresponding to a first cutting edge 37 and a second cutting edge (not illustrated). For sharpening, the blade 27 is placed between the arms 3, 5 of the tweezers 1. The root 31 of the second cutting edge is then pressed against the superabrasive layer 23 at a desired angle. The second cutting edge is then slid under light pressure along the superabrasive layer 23 until the entire length of the edge has contacted the superabrasive layer, i.e., from root 31 to tip 29. Next, the first cutting edge 37 on the first side 35 is slid along the superabrasive layer 23 in similar fashion. The process is then repeated until each cutting edge of the blade 27 is sufficiently sharp.

In the case of the embodiment including a plurality of superabrasive layer of differing abrasive textures, the sharpening process varies only slightly. Such an embodiment is particularly suited to sharpening extremely dull or damaged blades which require a rough sharpening before a fine edge can be put on the blade. In order to do so, the sharpening procedure recited above would be carried out, first with the layer of greater abrasive texture, and then with the layer of less abrasive texture.

FIG. 4 illustrates a folding pocket knife 25 adapted to secure the tweezers 1 (FIGS. 1–3) of the present invention. The knife 25 includes a plurality of folding blades (not illustrated) which are pivotally attached to the hilt 33. The hilt 33 includes a rectangular box channel 39 which is formed to accept the tweezers for storage. The channel 39 has a length 13 and a width 15, both of which are substantially equal to the clearance length 13 (FIG. 1) and width 15 (FIG. 2) dimensions of the tweezers 1 (FIGS. 1–3). The channel 39 also includes a depth (not illustrated) which is sufficient to hold the arms 3, 5 (FIGS. 1–3) of the tweezers closed relative to their free standing posture (See FIG. 1).

The tweezers are adapted to be secured to the knife 25 by means of the arms 3, 5 (FIGS. 1–3) and the head 7 (FIG. 1). For storage, the tweezers are first closed by pressing the arms together. The arms are then fed into the channel 39, jaw 11 (FIG. 1) end first. The head, being slightly larger in one or more dimensions than the combined arms, prevents the tweezers from sliding so far into the channel that they become difficult to retrieve. The tweezers are prevented from sliding out of the channel by the outward force of the compressed arms. The design of the tweezers themselves, absent the superabrasive layer, and their manner of storage in the knife hilt are already presently known and not being claimed here.

Although the invention has been shown and described with respect to the above detailed embodiment, it should be understood by those skilled in the art that various changes in form and detail may be made without departing from the spirit and scope of the claimed invention. For example, a non-tweezers V-shaped appendage might be used to obtain similar results. In further example, the superabrasive layer of the present invention could be attached to an appendage without a V-shape, e.g., a flat strip or a rod. In still further example, the appendage could also be secured to the handle of a fixed blade knife.

What is claimed is:

1. A knife blade sharpener, comprising an elongated appendage adapted to be removably secured to a knife handle, said removable appendage comprising a V-shaped tweezers having a pair of pivotally attached resilient arms with working surfaces at the non-attached end of the arms, at least one of said arms carrying an abrasive layer on its surface.

2. The blade sharpener of claim 1 wherein said abrasive layer is disposed upon at least one of first and second opposing inside surfaces of said arms of said tweezers.

3. The blade sharpener of claim 2 wherein said abrasive layer is disposed upon both (said first inside surface) and (said second inside surface) of said tweezers, thereby creating first and a second inside sharpening surfaces.

4. The blade sharpener of claim 3 wherein said first inside sharpening surface is of coarser abrasive texture than said second inside sharpening surface.

5. The blade sharpener of claim 1 wherein said abrasive layer is disposed upon a first outside surface of said arms of said tweezers.

6. The blade sharpener of claim 5 wherein said abrasive layer is disposed upon both said first outside surface and a second outside surface of said arms of said tweezers, thereby creating a first and a second outside sharpening surface.

7. The blade sharpener of claim 6 wherein said first outside sharpening surface is of greater abrasive texture than said second outside sharpening surface.

8. The blade sharpener of claim 1 wherein said abrasive layer includes a grit selected from the group consisting of diamond, silicon carbide, and aluminum oxide.

9. The blade sharpener of claim 1 wherein said abrasive is a superabrasive attached to said removable appendage by a bonding means.

10. The blade sharpener of claim 9 wherein said bonding means is electroplated metal.

11. The blade sharpener of claim 1 wherein said abrasive layer includes a free standing slab of diamond layer produced by chemical vapor deposition.

12. A compact, lightweight, durable blade sharpener which can be secured to, and stored with, a folding blade pocket knife of the Swiss army type having a detachable tweezers feature and which fits removably into a rectangular box channel in the knife handle, comprising:

a pair of tweezers having two resiliently opposed arms attached in cantilever fashion, each said arm having an inside surface; and a diamond grit layer electroplated to said inside surfaces of said tweezer arms.

13. A knife comprising a blade and a handle, the handle including an elongate channel and a sharpening tool removably secured in the channel, wherein the sharpening tool is a tweezers having two arms attached in cantilever fashion, each said arm having an inside surface and an outside surface, the abrasive layer being secured to at least one of said surfaces of at least one arm of the tweezers.

14. The knife according to claim 13 wherein the abrasive layer is a diamond grit layer electroplated to at least one of said inside surfaces of said tweezers.

* * * * *